US007866770B2

(12) United States Patent
Wu

(10) Patent No.: US 7,866,770 B2
(45) Date of Patent: Jan. 11, 2011

(54) CABINET ASSEMBLY

(76) Inventor: Chieh Ly Wu, No. 2, Lane 65, Sec. 2, Chye Dong Road, Dah Tsuen Shiang, Chang Hua Hsien (TW) 515

( * ) Notice: Subject to any disclaimer, the term of this patent is extended or adjusted under 35 U.S.C. 154(b) by 728 days.

(21) Appl. No.: 11/808,796

(22) Filed: Jun. 13, 2007

(65) Prior Publication Data

US 2008/0284298 A1 Nov. 20, 2008

(51) Int. Cl.
*A47B 47/00* (2006.01)

(52) U.S. Cl. ..... 312/263; 312/257.1

(58) Field of Classification Search ..... 312/257.1, 312/263, 265.1, 265.2, 265.3, 265.4, 265.5, 312/265.6, 111, 100, 326, 329; 52/79.5
See application file for complete search history.

(56) References Cited

U.S. PATENT DOCUMENTS 3,856,374 A * 12/1974 Christen ..... 312/263
3,866,993 A * 2/1975 Dean et al. ..... 312/216
4,288,132 A * 9/1981 Znamirowski et al. ... 312/265.5
5,441,337 A * 8/1995 Mazura et al. ..... 312/265.5
6,027,192 A * 2/2000 Irace ..... 312/263
6,250,022 B1 * 6/2001 Paz et al. ..... 52/79.5
6,409,293 B1 * 6/2002 Chang ..... 312/257.1
6,474,759 B2 * 11/2002 Hsu ..... 312/263
6,892,497 B2 * 5/2005 Moon et al. ..... 52/79.1

* cited by examiner

*Primary Examiner*—James O Hansen
(74) *Attorney, Agent, or Firm*—Bacon & Thomas, PLLC

(57) ABSTRACT

A cabinet assembly includes a base, a top board, two side panels and a rear board, the two side panels each have connection plates on four corners and the connection plates are inserted into slots defined in the front end and the rear end of the top board and the base. The rear panel includes tow boards which are engaged with each other at their two respective inner sides thereof by engaging a side flange on one board with an engaging groove in the other board. One of the two boards includes an insertion at a lower end thereof and the insertion is inserted into a recess defined in a top of the rear end of the base. The top end, the lower end and the outer side of each of the boards of the rear panel are respectively connected to the top board, the base and the side panels by engagement of flanges and engaging grooves.

8 Claims, 9 Drawing Sheets

CABINET ASSEMBLY

FIELD OF THE INVENTION

The present invention relates to a cabinet assembly which is easily manufactured and assembled.

BACKGROUND OF THE INVENTION

A conventional cabinet 7 is shown in FIG. 9 and generally includes several metal boards 71 which are made and cut into desired sizes in factories and the metal boards 71 are connected to each other by welding. The conventional cabinet 7 occupies a huge space and the assemblers have to move, rotate and flip the cabinet during welding processes. Furthermore, the bulky cabinets occupy huge space which increases the cost for transportation.

The present invention intends to provide a cabinet assembly which includes a base, a top, two side panels and a rear panel, only few screws are needed to assemble the cabinet.

SUMMARY OF THE INVENTION

The present invention relates to a cabinet assembly which comprises a base having two first slots defined in a front end and a rear end thereof, a recess is defined in a top of the rear end of the base. A rear panel is composed of two boards and each board has an engaging grove defined in a top and an outer side thereof. A bottom flange extends laterally from a lower end of each of the two boards. One of the two boards has an insertion extending longitudinally from the lower end thereof. Two side panels each have four connection plates extending laterally from four corners thereof. A first connection flange is formed on a rear side of each of the two side panels and the two respective connection flanges are connected to the two boards of the rear panel. A top board has two second slots defined in a front end and a rear end thereof. A second connection flange is connected to the rear end of the top board.

The primary object of the present invention is to provide a cabinet assembly which is assembled by a base, a top board, two side panels and a rear panel by engagement of flanges and engaging grooves. Few screws are used to secure the engagement of the parts so that the cabinet assembly is easily assembled without welding.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
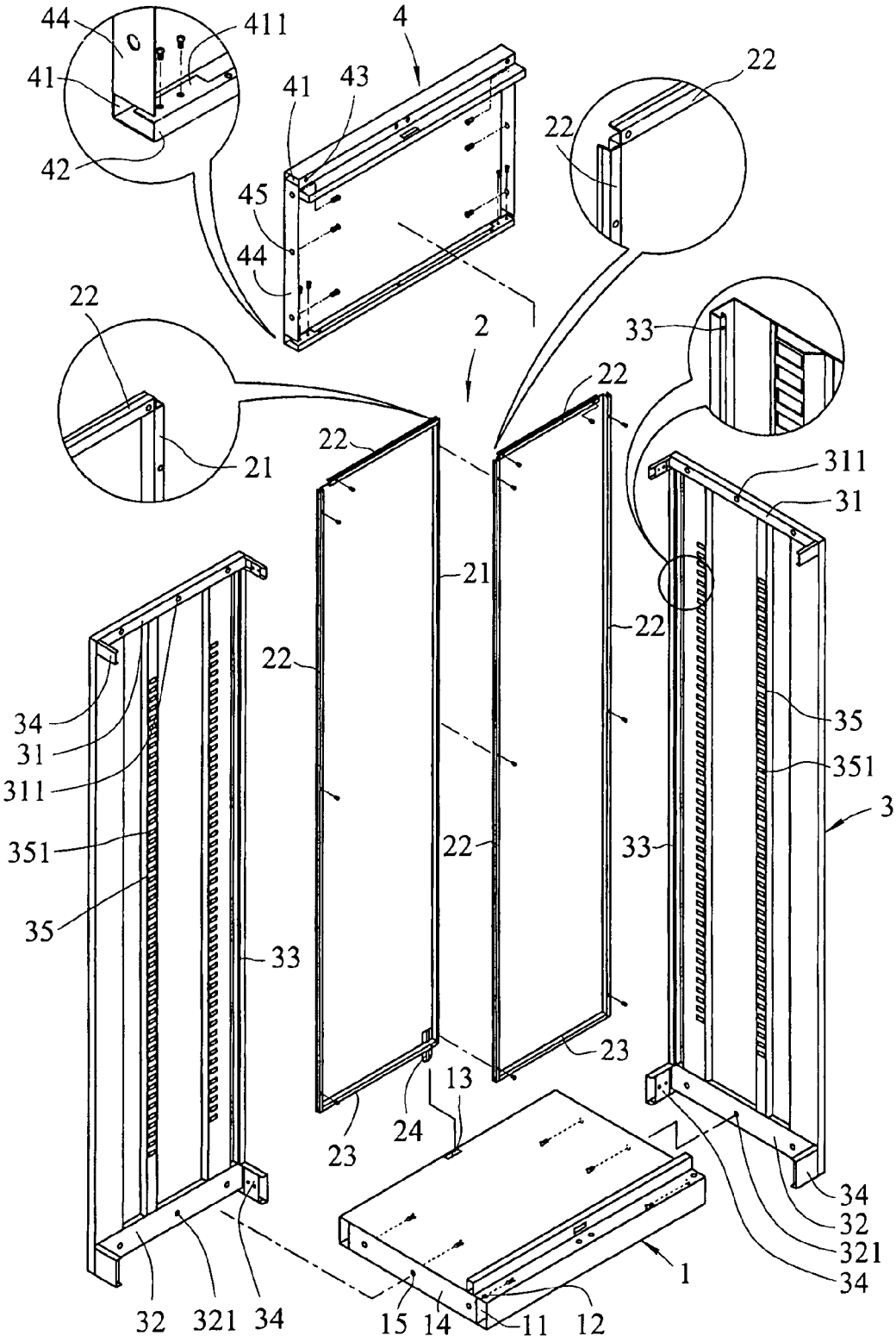
FIG. 1 is an exploded view to show the cabinet assembly of the present invention.
Figure 2:
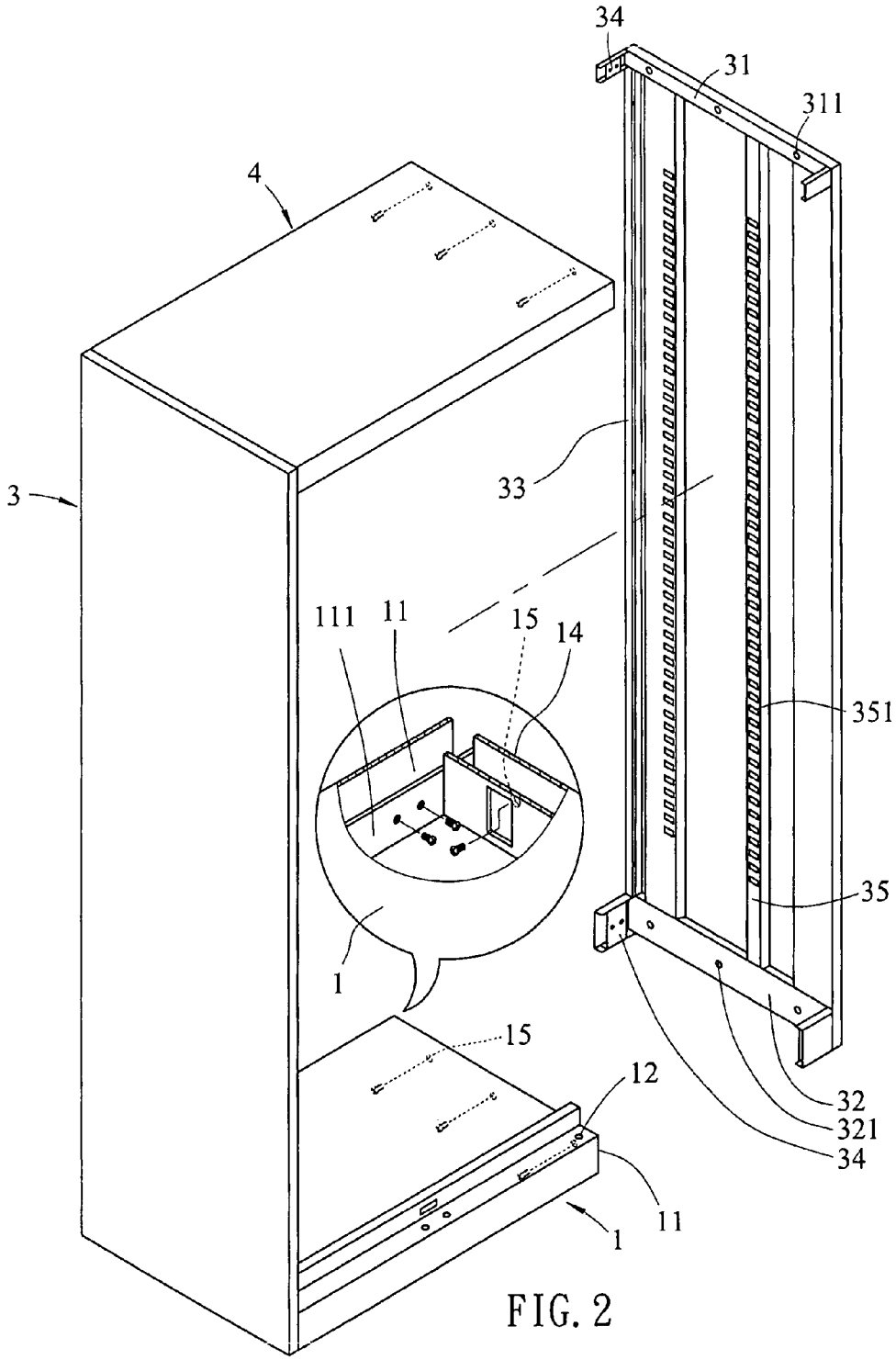
FIG. 2 shows the two side panels are connected between the top board and the base.
Figure 3:
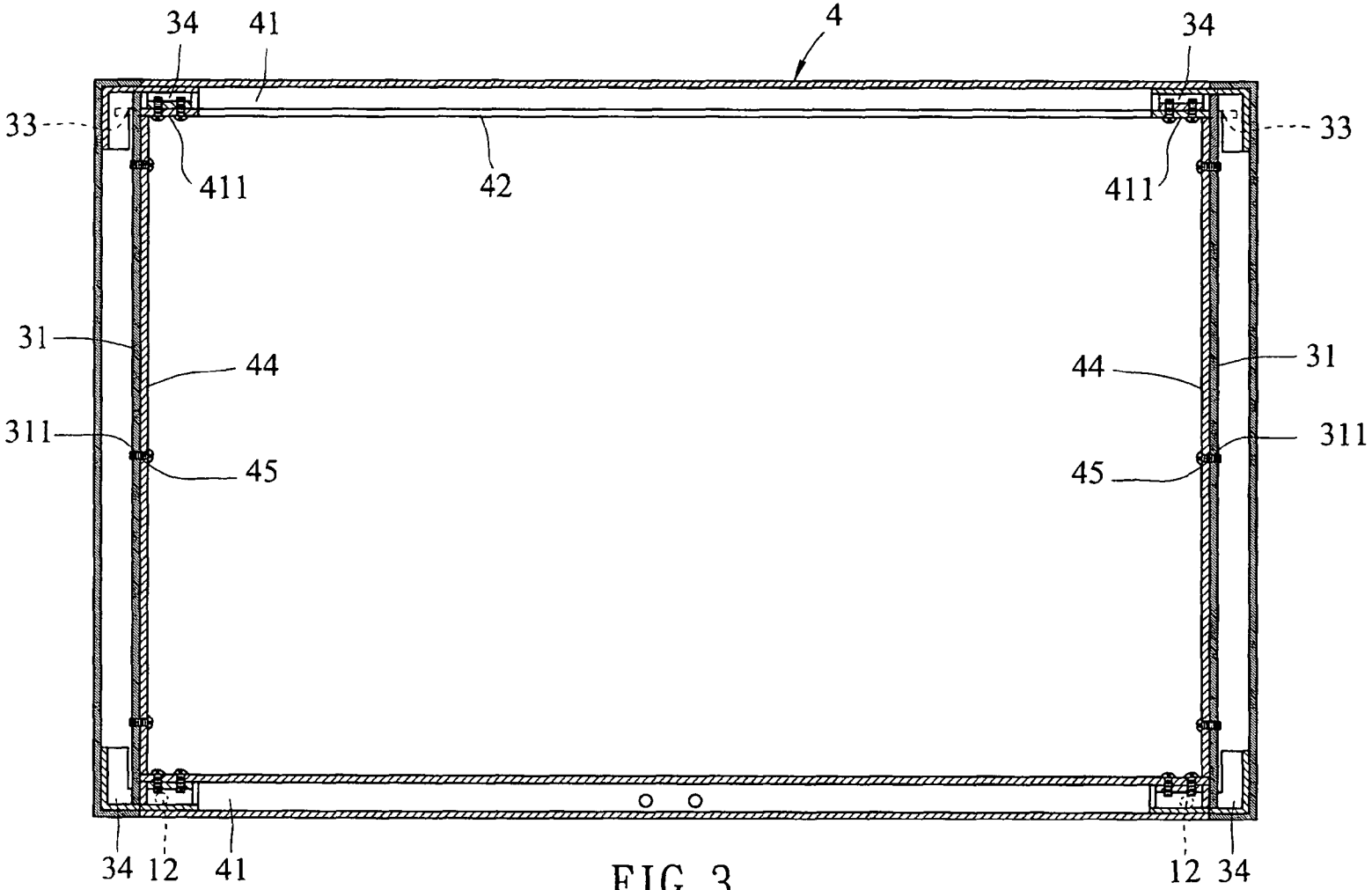
FIG. 3 is a top cross sectional view of the cabinet assembly of the present invention.
Figure 4:
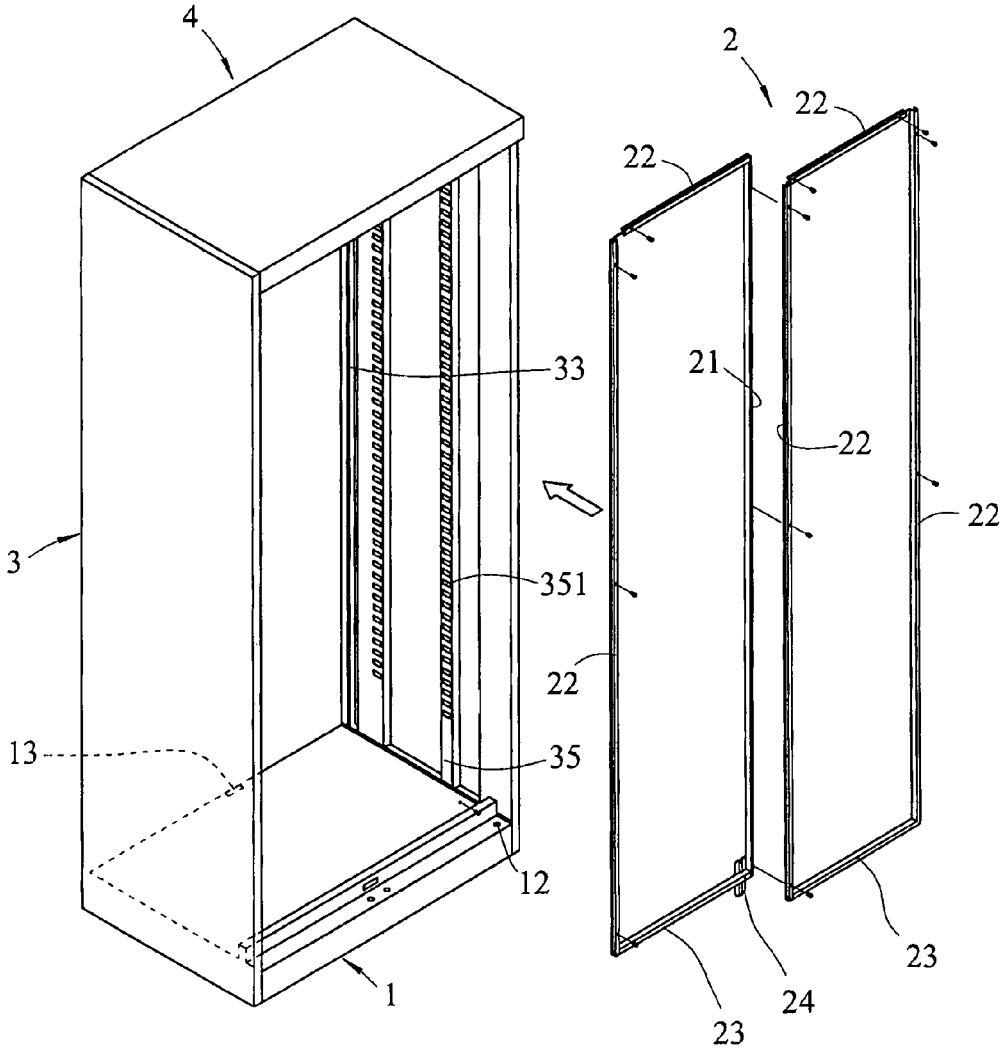
FIG. 4 shows the two boards of the rear panel are to be connected between the two side panels.

Referring to FIGS. 1 to 6, the cabinet assembly of the present invention comprises a base 1 having two first slots 11 defined in a front end and a rear end thereof, and a recess 13 is defined in a top of the rear end of the base 1. Two holes 12 are defined in a top surface of the first slot 11 of the front end of the base 1. The base 1 has two sidewalls 14 on two sides thereof and a plurality of holes 15 are defined through the sidewalls 14.

Figure 5:
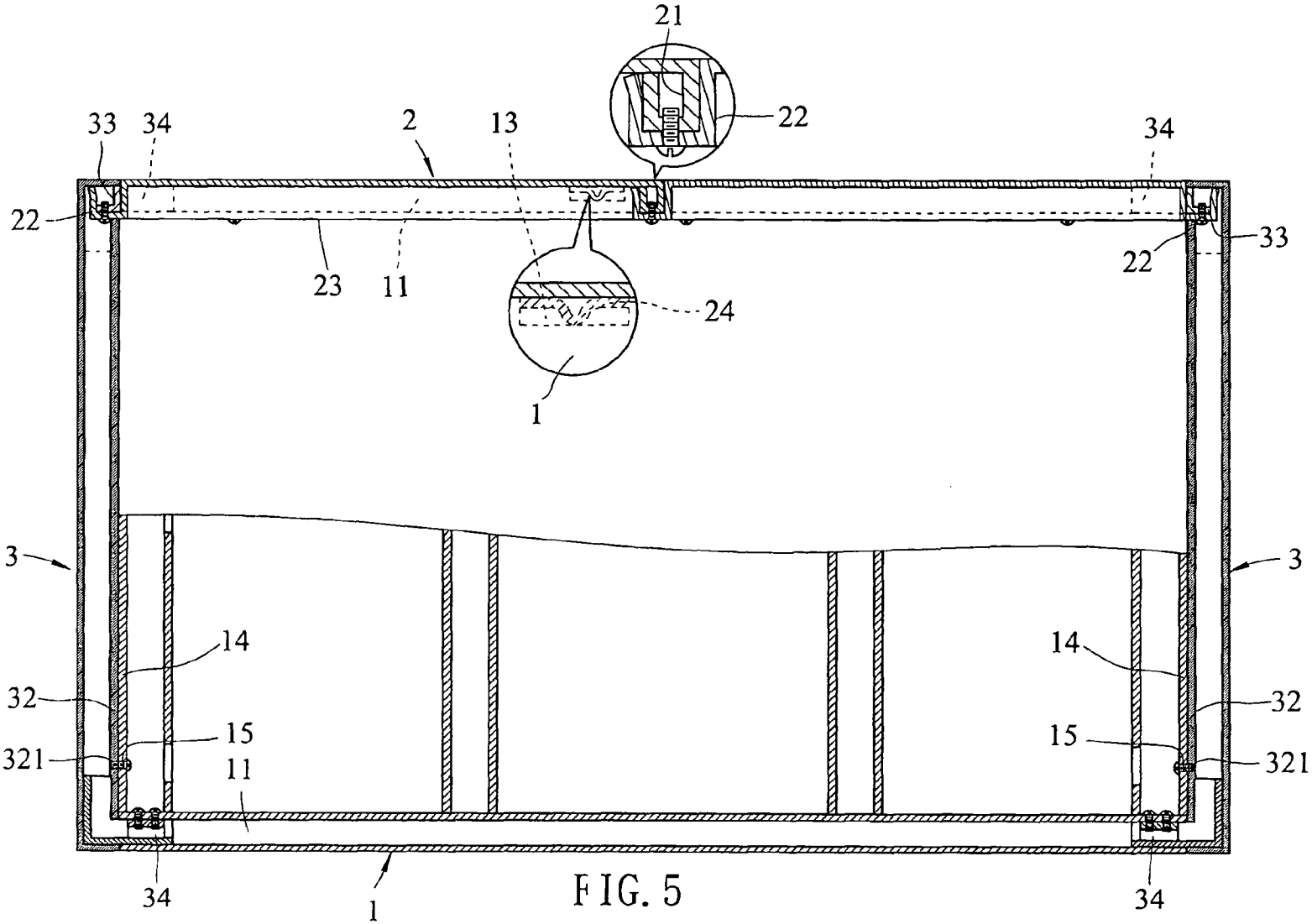
FIG. 5 shows the connection of the two boards of the rear panel.
Figure 6:
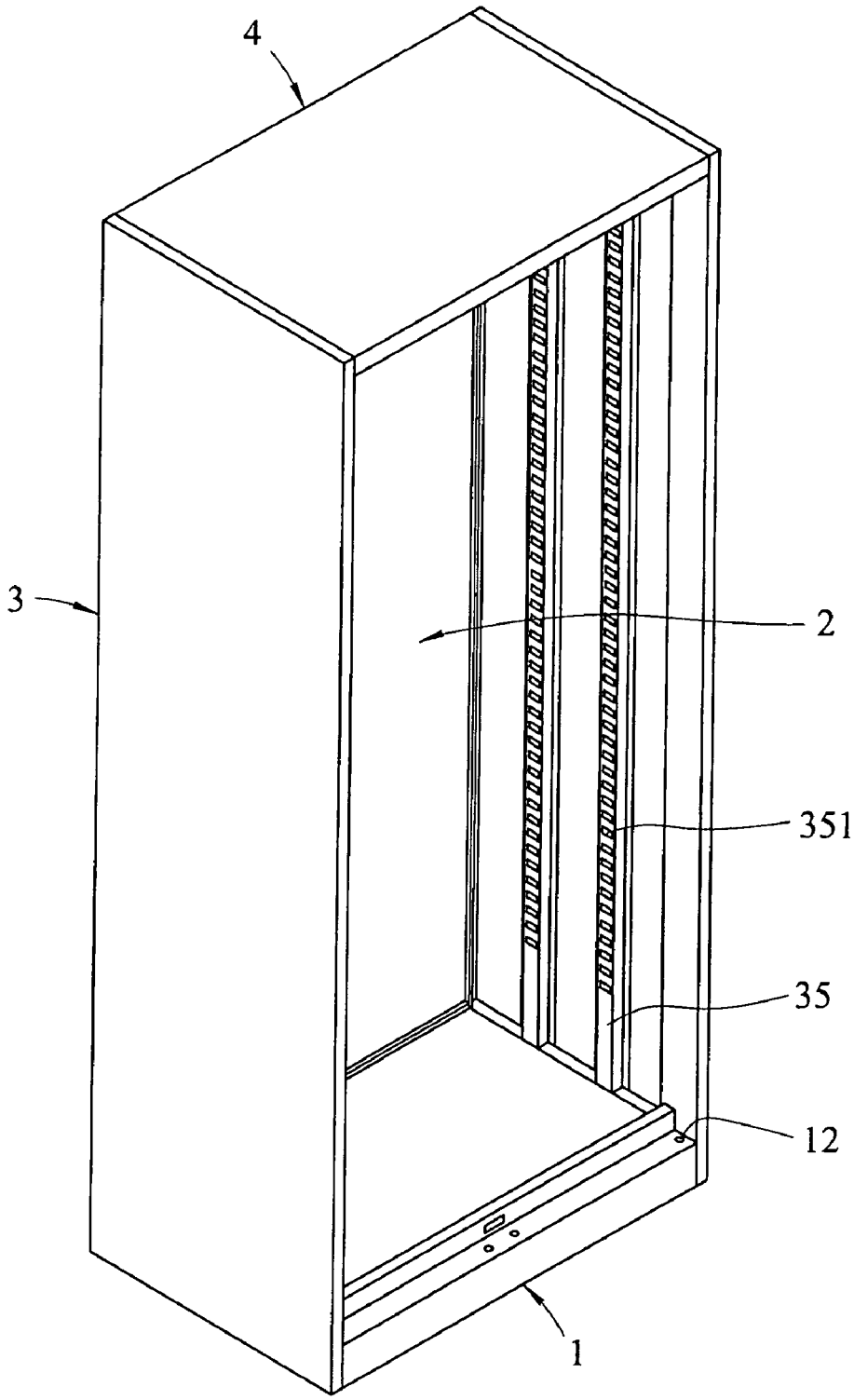
FIG. 6 shows the cabinet assembly of the present invention except for the doors.

A rear panel 2 is composed of two boards and each board has an engaging groove 22 defined in a top and an outer side thereof, and a bottom flange 23 extends laterally from a lower end of each of the two boards. One of the two boards has an insertion 24 extending longitudinally from the lower end thereof. The board having the insertion 24 of the rear panel 2 includes a side flange 21 on an inner side thereof and the other one of the two boards of the rear panel 2 includes an engaging groove 22 defined in an inner side thereof. The side flange 21 is engaged with the engaging groove 22 so as to connect the two boards side by side as shown in FIG. 5. Three screws extend through the walls of the side flange 21 and the engaging groove 22 to secure the connection.

Two side panels 3 each have four connection plates 34 extending laterally from four corners thereof. A first connection flange 33 is formed on a rear side of each of the two side panels 3 and the two respective first connection flanges 33 connected to the engaging grooves 22 of the two boards of the rear panel 2 by screws as shown in FIG. 5. Two racks 35 are connected to two insides of the two side panels 3 and each rack 35 has positioning holes 351, a plurality of separation boards 352 are connected to the positioning holes 351 and located between the two side panels 3 as shown in FIG. 7.

A top board 4 has two second slots 41 defined in a front end and a rear end thereof, a second connection flange 42 is connected to the rear end of the top board 4.

The connection plates 34 of the two side panels 3 are inserted into the first slots 11 of the base 1 and the second slots 41 of the top board 4. Screws connect walls of the first and second slots 11, 41 to two respective inner boards 111, 411 of the first and second slots 11 and 41. The top board 4 has two sidewalls 44 on two sides thereof and a plurality of holes 45 are defined through the sidewalls 44. Each of the two side panels 3 has an upper connection portion 31 and a lower connection portion 32 on two ends thereof. Each of the upper connection portion 31 and the lower connection portion 32 includes holes 311/321, the sidewalls 14, 44 of the base 1 and the top board 4 are connected to the upper connection portion 31 and the lower connection portion 32 of the two side panels 3 by screws. The engaging grooves 22 of the two boards of the rear panel 2 are connected with the first and second connection flanges 33, 42 of the side panels 3 and the top board 4. The insertion 24 of one of the two boards of the rear panel 2 is inserted into the recess 13 on the base 1.

Figure 7:
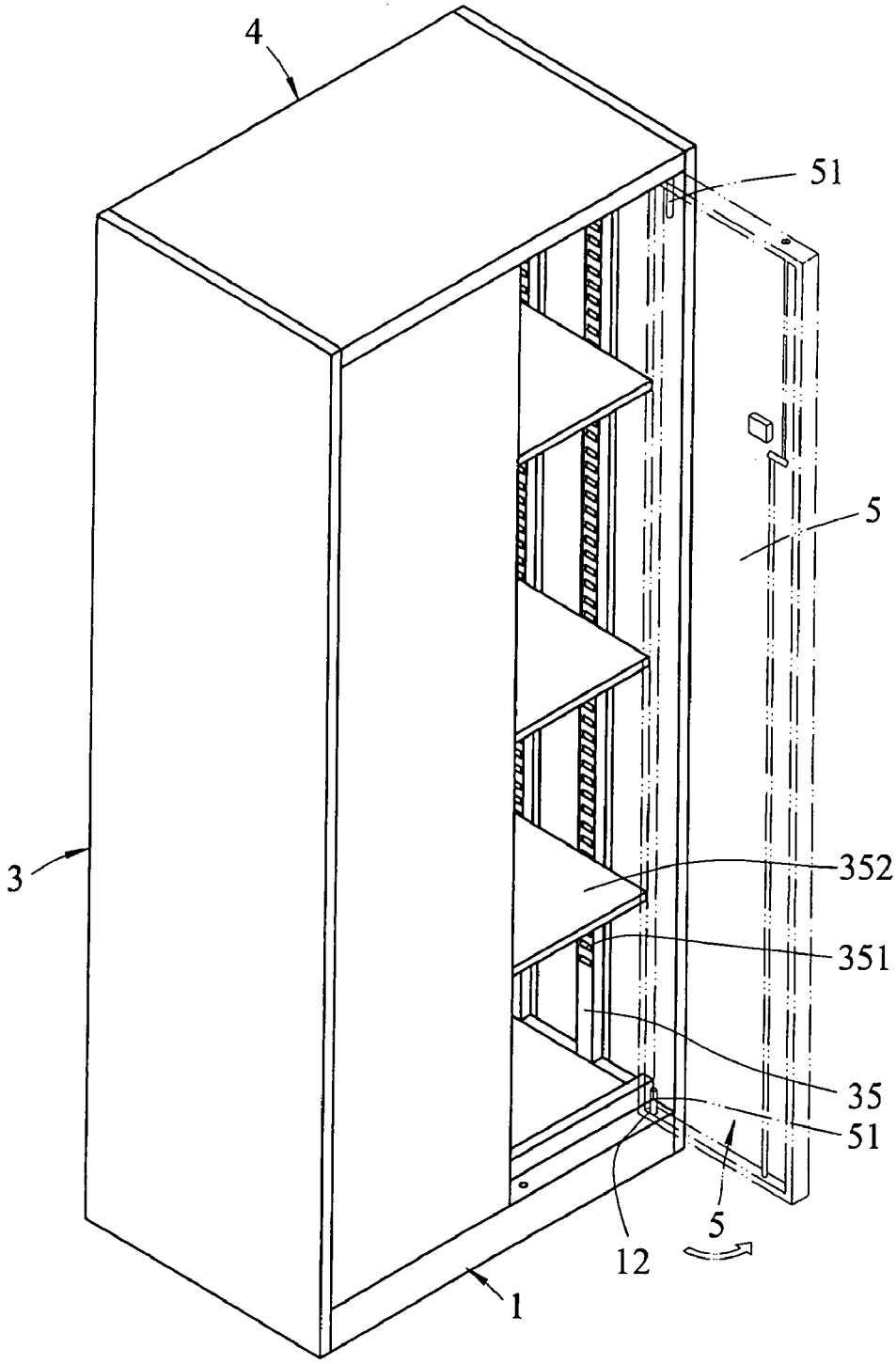
FIG. 7 shows two doors are pivotably installed to the cabinet assembly.

Further referring to FIG. 7, two holes 43 are defined in a front surface of the second slot 41 on the front side of the top board 4 and two doors 5 are connected between the top board 4 and the base 1 and two respective pivots 51 of the doors 5 are connected to the holes 12 of the base 1.

Figure 8:
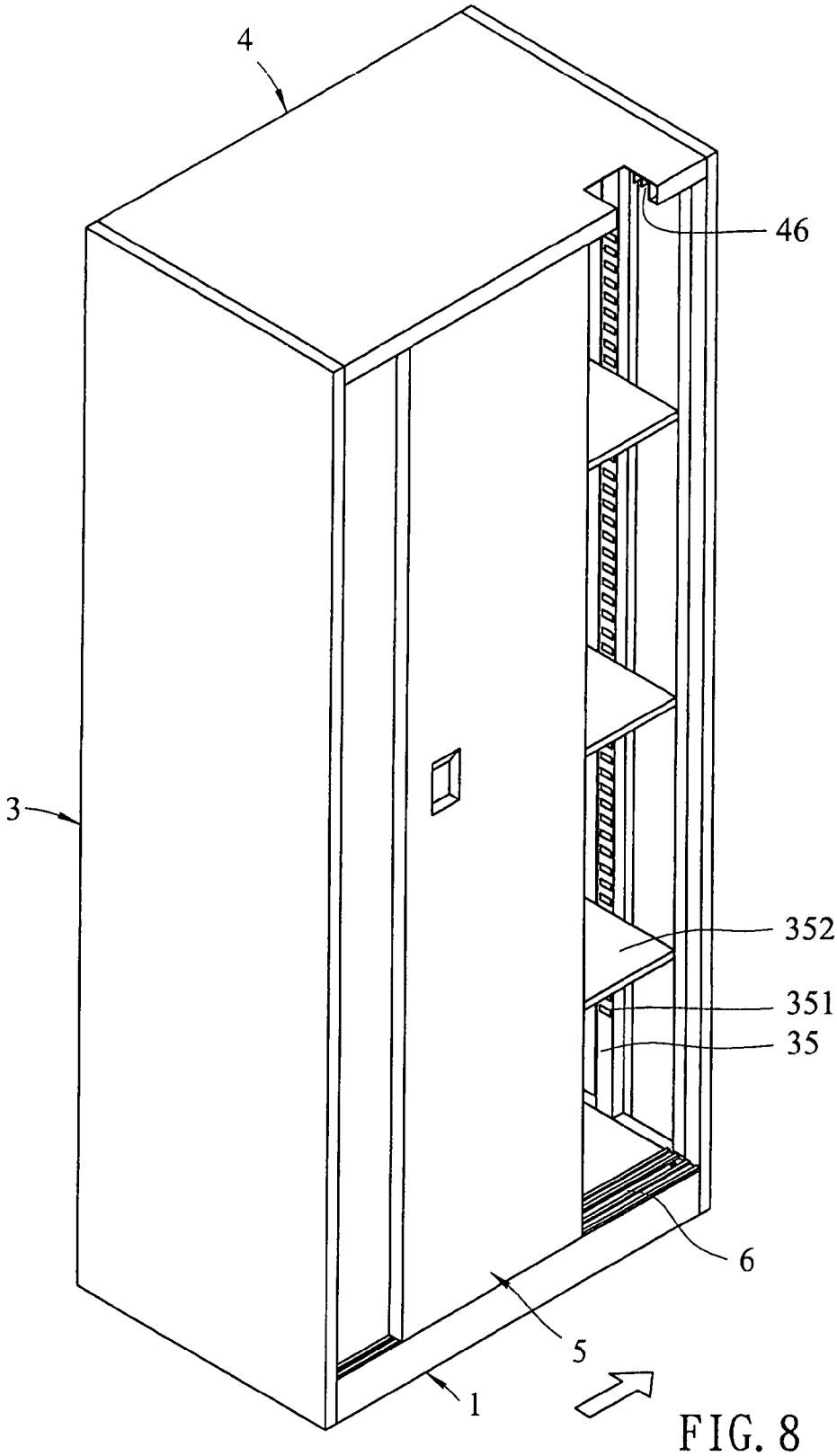
FIG. 8 shows another type of doors are installed to the cabinet assembly.
Figure 9:
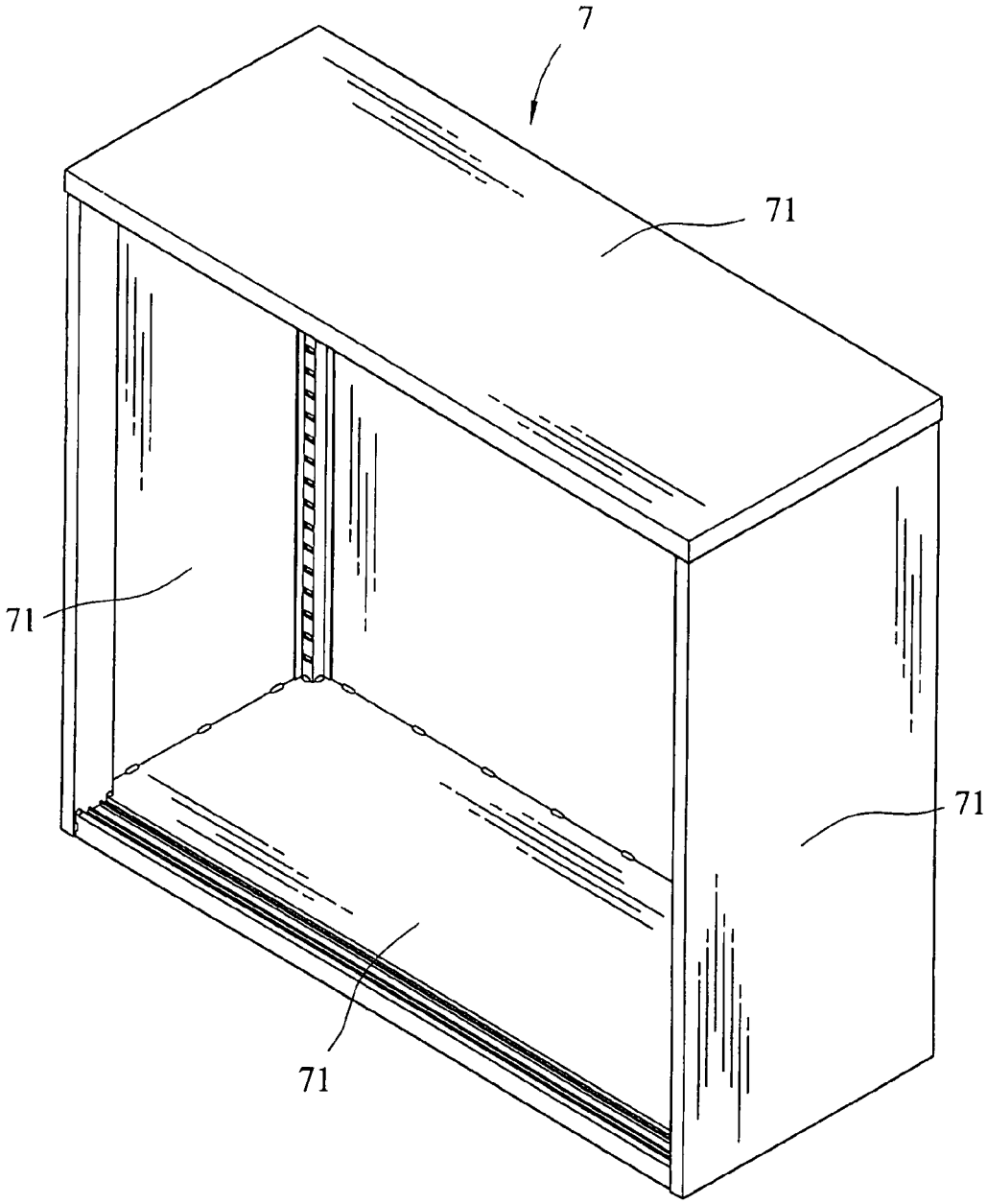
FIG. 9 PRIOR ART
FIG. 9 shows a conventional cabinet.

FIG. 8 shows another type of doors 5 is used to the cabinet assembly wherein a rail unit 6 is connected to a top of the base 1 and the top board 4 includes guide grooves 46, two doors 5 are slidably engaged with the rail unit 6 and the guide grooves 46.

The base 1, the top board 4, the two side panels 3 and the rear panel 2 are easily manufactured and can be conveniently stacked and transported efficiently. The assembly process is easy and does not need welding machine.

While we have shown and described the embodiment in accordance with the present invention, it should be clear to those skilled in the art that further embodiments may be made without departing from the scope of the present invention.

What is claimed is:

1. A cabinet assembly comprising:

a base (1) having two first slots (11) defined in a front end and a rear end thereof, a recess (13) defined in a top of the rear end of the base (1);

a rear panel (2) composed of two boards and each board having an engaging groove (22) defined in a top and an outer side thereof, a bottom flange (23) extending laterally from a lower end of each of the two boards, one of the two boards having an insertion (24) extending longitudinally from the lower end thereof;

two side panels (3) each having four connection plates (34) extending laterally from four corners thereof, a first connection flange (33) formed on a rear side of each of the two side panels (3) and the two respective connection flanges (33) connected to the two boards of the rear panel (2), and a top board (4) having two second slots (41) defined in a front end and a rear end thereof, a second connection flange (42) connected to the rear end of the top board (4), wherein the connection plates (34) on the two side panels (3) are inserted into the first slots (11) of the base (1) and the second slots (41) of the top board (4), screws connect walls of the first and second slots (11, 41) to two respective inner boards (111, 411) of the first and second slots (11) and (41).

2. The assembly as claimed in claim 1, wherein each of the base (1) and the top board (4) has two sidewalls (14/44) on two sides thereof and a plurality of holes (15/45) are defined through the sidewalls (14) and (44), each of the two side panels (3) has an upper connection portion (31) and a lower-connection portion (32) on two ends thereof, each of the upper connectionportion (31) and the lower connection portion (32) includes holes (311/321), the sidewalls (14, 44) of the base 1 and the top board (4) are connected to the upper connection portion (31) and the lower connection portion (32) of the two side panels (3) by screws.

3. The assembly as claimed in claim 1, wherein the engaging grooves (22) of the two boards of the rear panel (2) are connected with the first and second connection flanges (33, 42) of the side panels (3) and the top board (4).

4. The assembly as claimed in claim 1, wherein the insertion (24) of one of the two boards of the rear panel (2) is inserted into the recess (13) on the base (1).

5. The assembly as claimed in claim 1, wherein one of the two boards of the rear panel (2) includes a side flange (21) on an inner side thereof and the other one of the two boards of the rear panel (2) includes an engaging groove (22) defined in an inner side thereof, the side flange (21) is engaged with the engaging groove (22) so as to connect the two boards side by side.

6. The assembly as claimed in claim 1, wherein two holes (43) are defined in a front surface of the second slot (41) on the front side of the top board (4) and two holes (12) are defined in a top surface of the first slot (11) of the front end of the base (1), two doors (5) are connected between the top board (4) and the base (1) and two respective pivots (51) of the doors (5) are connected to the holes (12) of the base (1).

7. The assembly as claimed in claim 1, wherein two racks (35) are connected to two insides of the two side panels (3) and each rack (35) has positioning holes (351), a plurality of separation boards (352) are connected to the positioning holes (351) and located between the two side panels (3).

8. The assembly as claimed in claim 1, wherein a rail unit (6) is connected to a top of the base (1) and the top board (4) includes guide grooves (46), two doors (5) are movably engaged with the rail unit (6) and the guide grooves (46).

* * * * *